US005339060A

United States Patent [19]

Blanchard et al.

[11] Patent Number: 5,339,060

[45] Date of Patent: Aug. 16, 1994

[54] PROTECTIVE SWITCH

[75] Inventors: Christian Blanchard, Rueil-Malmaison; Michel Lauraire, Saint Maur Des Fosses; Didier Vigouroux, Jouy-Le-Moutier, all of France

[73] Assignee: Telemecanique, Rueil Malmaison, France

[21] Appl. No.: 65,775

[22] Filed: May 24, 1993

[30] Foreign Application Priority Data

May 22, 1992 [FR] France ..... 92 06270

[51] Int. Cl.[5] ..... H01H 67/02

[52] U.S. Cl. ..... 335/132; 335/202

[58] Field of Search ..... 335/131, 132, 167–176, 335/202

[56] References Cited

U.S. PATENT DOCUMENTS

| | | | |
|---|---|---|---|
| 4,356,368 | 10/1982 | Osika | 335/132 |
| 4,926,149 | 5/1990 | Saens et al. | 335/132 |
| 5,233,321 | 8/1993 | Blanchard et al. | 335/132 |
| 5,241,290 | 8/1993 | Sehmer et al. | 335/6 |

FOREIGN PATENT DOCUMENTS 0114542 1/1984 European Pat. Off. .

4123563 1/1992 Fed. Rep. of Germany .

*Primary Examiner*—Lincoln Donovan

*Attorney, Agent, or Firm*—Oblon, Spivak, McClelland, Maier & Neustadt

[57] ABSTRACT

A protective switch device such as a relay switch includes at least one pole having at least one moving contact that cooperates with a stationary contact and a magnetic or thermal trip mechanism for assuring protection against overloads and excess currents and that acts on a control mechanism actuating the moving contact and that can be activated by a rotary control knob rotating about a pivot pin. Recocking of the control mechanism is possible from a "tripped" to an "off" or from a "tripped" to an "on" position. The control mechanism includes a lever for opening the contacts that pivots from an on position corresponding to the closing of the contacts to a position corresponding to the opening of the contacts. The opening lever is associated with a pivoting cocking mechanism, which is able to bring back and hold the opening lever in the on position. A trip mechanism is provided which is able to control the mechanical separation of the opening lever and the cocking mechanism so as to free the opening lever.

9 Claims, 3 Drawing Sheets

PROTECTIVE SWITCH

BACKGROUND OF THE INVENTION

1. Field of the Invention

This invention relates to a protective switch such as a relay switch, comprising at least one pole having at least one moving contact that cooperates with a stationary contact and magnetic or thermal trip means assuring protection against overloads and excess currents and that act on a control mechanism actuating said moving contact and that can be activated by a rotary control knob rotating around a pivot pin.

2. Discussion of the Background

Protective switch devices such as relay switches comprise, for each pole, a contact bridge able to be displaced in relation to the stationary contacts. In case of an electrical failure on at least one of the poles, a magnetic and/or thermal trip mechanism is able to cause an opening of the contacts. This trip mechanism acts on a control mechanism referred to as a lock. Furthermore, this control mechanism can be activated manually by a manual control knob so as to displace the moving contacts in relation to the stationary contacts by a switch controlling the electromagnet.

SUMMARY OF THE INVENTION

This invention has as its object to provide a control mechanism for a protective device such as a relay switch whose design is simple and which is easy to assemble. The parts that make up the mechanism are limited in number. The recocking of the mechanism is possible from "tripped" to "off" or from "tripped" to "on".

The device according to the invention is characterized by the fact that the control mechanism comprises a lever for opening the contacts that pivots from an on position corresponding to the closing of the contacts to a position corresponding to the opening of the contacts, this opening lever being associated with a pivoting cocking mechanism, able to bring back and hold said opening lever in the "on" position of the contacts, and by the fact that the trip means are able to control the mechanical separation of the opening lever and of the cocking mechanism so as to free this opening lever.

According to a characteristic, the pivoting cocking mechanism comprises a cocking lever that pivots around the mechanism pin, this cocking lever being associated with hooking means that can assure a connection upon rotation of the opening lever.

According to another characteristic, the cocking lever is connected mechanically upon rotation to a pivoting cocking part subject to the biasing force of a cocking spring.

According to another characteristic, the cocking mechanism comprises a latch for assuring immobilization of said mechanism in "on" position and freeing said mechanism under the action of the opening part so that said mechanism shifts the opening lever from a trip position back into an "on" position.

According to another characteristic, the mechanism comprises a pusher able to free the opening lever of the cocking mechanism by acting on the hook and associated with a trip mechanism on which the magnetic and/or thermal trip means act.

BRIEF DESCRIPTION OF THE DRAWINGS

The invention will now be described with greater detail by referring to an embodiment given by way of example and represented by the accompanying drawings in which.

DESCRIPTION OF THE PREFERRED EMBODIMENTS

Figure 1:
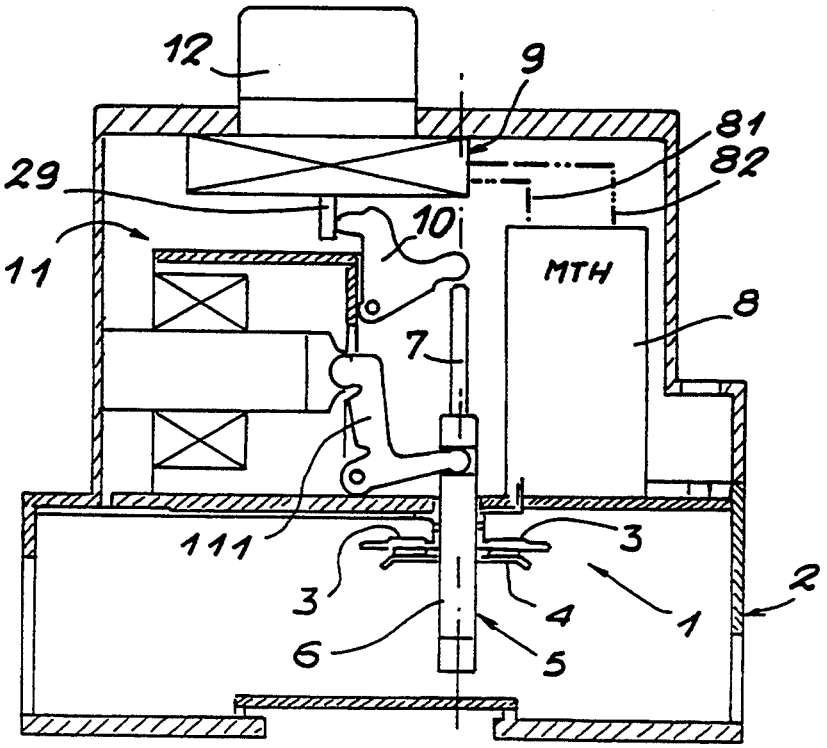
FIG. 1 represents diagrammatically, in elevation, a protective device according to the invention.
Figure 2:
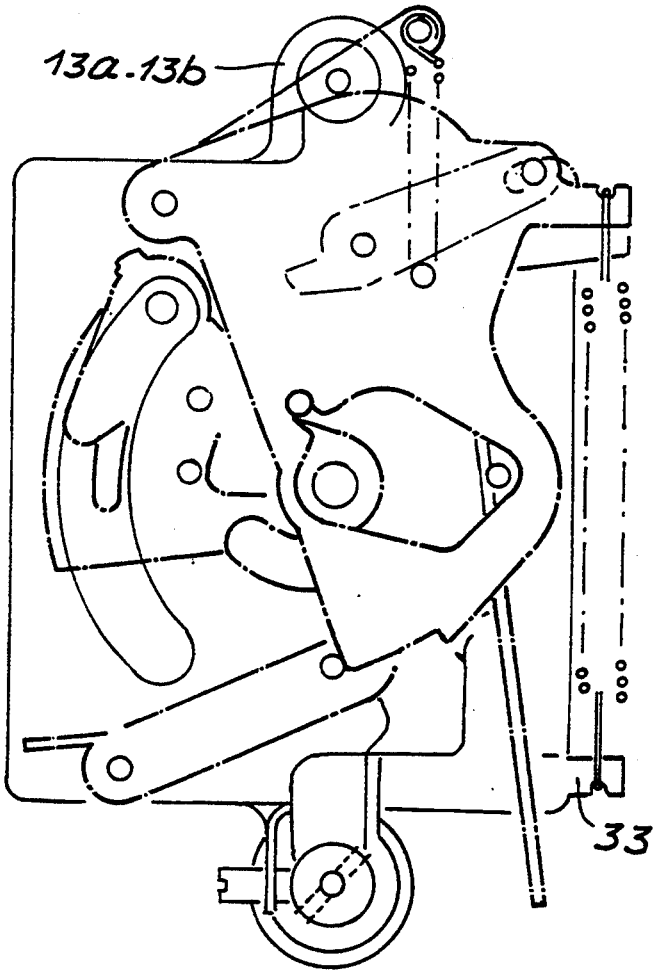
FIG. 2 is a diagram, in elevation, of the control mechanism of the device according to the invention.

The protective switch, of a relay switch type, which is represented in FIG. 1, comprises one or more poles 1 housed in a box 2. Each pole 1 comprises stationary and moving parts supporting the contacts that can be separated.

A single pole 1, of a double break type, is represented in FIG. 1. This pole comprises conductors 3 connecting the connecting terminals to the stationary contacts and a moving contact bridge 4 carrying the moving contacts.

Moving bridge 4 cooperates, by contact disks, with the stationary contacts to establish or interrupt the passage of a power current between the connecting terminals. This moving bridge 4 is mounted in a mobile contact holder unit 5 that slides in the box, perpendicular to the plane that passes through the stationary contacts. This contact holder unit 5 comprises a sliding support 6 and a slide 7 guided in a housing of this sliding support. Slide 7 is integral in translation with contact bridge 4. It is subject to the biasing force of a pressure spring of the contacts that tends to displace contact bridge 4 in relation to sliding support 6, in the direction of closing of the contacts. The pressure spring of the contacts works in compression, rests on sliding support 6 and pushes back, in the direction of closing of the contacts, slide 7 and contact bridge 4.

A magnetic and thermal trip unit 8 is placed on each current path, in box 2. This magnetic and thermal trip unit 8 comprises, for example, for each pole, a magnetic and thermal trip mechanism. When unit 8 detects an excess current on the current path, it acts, by a control mechanism 9 and by a return swingletree 10, on slide or slides 7 for displacement of contact bridges 4.

An electromagnet 11 is housed in the box to activate the contact holder unit 5. It comprises a fixed magnetic circuit, a mobile armature and a coil connected electrically to terminals by a switch. The latter can be controlled by mechanism 9 or by a rotary control knob 12 that can act on the mechanism to open the contacts. The armature of the electromagnet is secured to a return spring and cooperates with a lever 111 that is directly attached to sliding support 6.

Contact holder unit 5 is therefore subject to the biasing force of the return spring of the electromagnet which tends to displace it toward the open position (open contacts).

Figure 3:
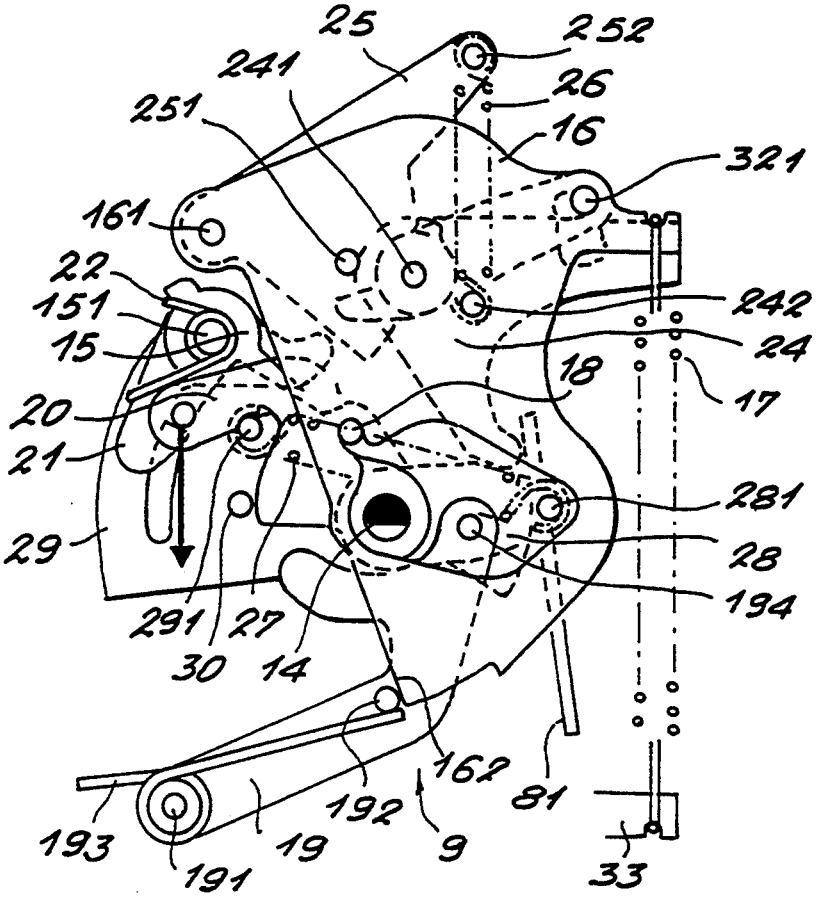
FIG. 3 is a simplified diagram of the control mechanism represented in an "on" position.

Control mechanism 9 is activated by a rotary control knob 12 that is placed on the front face of the box. Control mechanism 9 is mounted between two plates 13*a*, 13*b* fastened to the box. Manual rotary control knob 12 is mounted integrally with a pivot pin 14 that is guided in rotation by plates **13*a*–13*b*, parallel to the guide plane of contact holder unit 5. The pin 14 and knob 12 can pivot so as to occupy a beginning-of-travel position corresponding to the "on" position (contacts closed), an end-of-travel position corresponding to the "off" position (contacts open) or an intermediate position corresponding to a "tripped" position (contacts open). These different positions are respectively represented in FIGS. 3, 4, and 5. The "on" and "off" positions of control knob 12** are approximately 90° from one another.

An opening lever 20 is mounted so as to be freely rotatable around pin 14. This opening lever 20 is subject to the biasing force of an opening spring, not shown, which tends to cause it to pivot from the "on" position to the "tripped" position.

Figure 5:
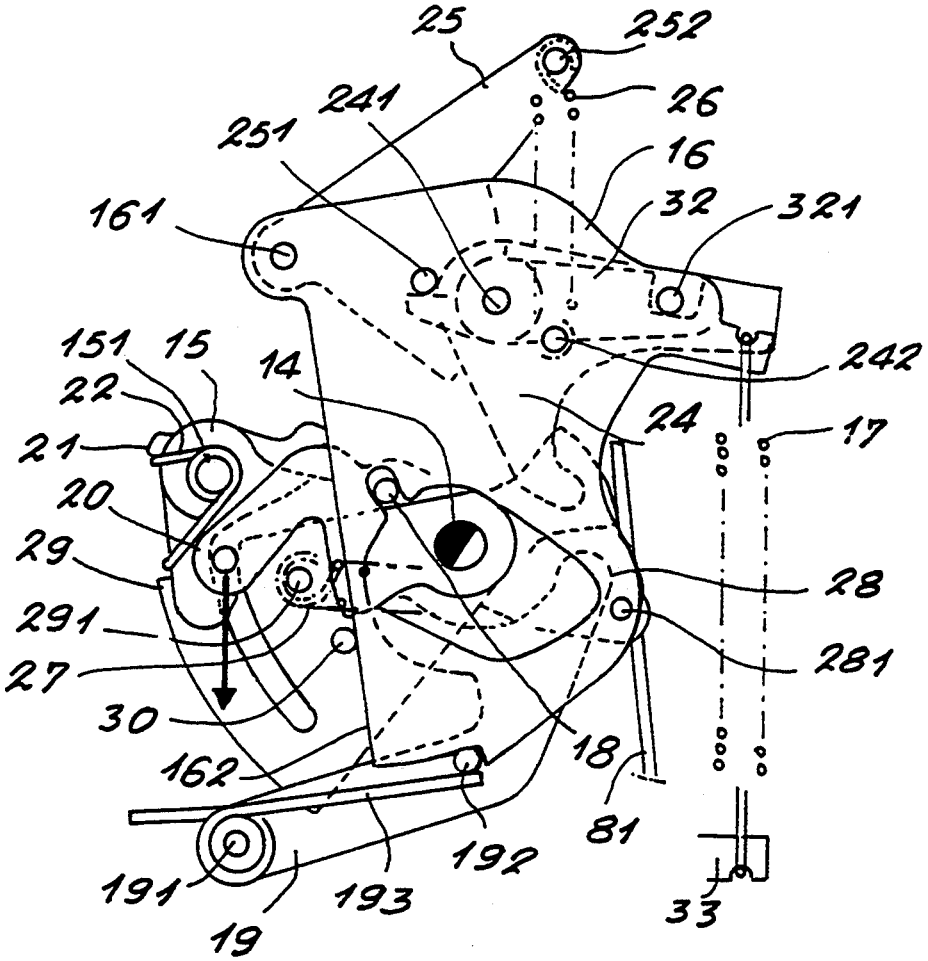
FIG. 5 is a simplified diagram of the control mechanism represented in a "tripped" position.

A cocking lever 15 is guided in rotation along pin 14 so as to pivot between an "on" position (FIG. 3) and a "tripped" position (FIG. 5). This cocking lever 15 pivots from the "on" position to the "tripped" position to grasp opening lever 20 and returns from the "tripped" position to the "on" position with opening lever 20. To perform this function, cocking lever 15 is secured to a cocking mechanism composed of a cocking part 16 mounted to pivot around a pin 161 and subject to the biasing force of a cocking spring 17. The mechanical connection in rotation between pivoting cocking lever 15 and cocking part 16 is performed by a drive pin 18.

Cocking part 16 cooperates with a swinging latch 19 that makes it possible to lock this part 16 in the "on" position or "tripped" position (FIG. 3 or 5) and consequently makes it possible to hold cocking lever 15 in the "on" or "tripped" position. This swinging latch 19 is mounted so as to pivot around a pin 191 and is subject to the biasing force of a return spring 193. A pin 192 is also provided that locks opening part 16 in the "on" or "tripped" position.

Unlocking of cocking part 16 is performed by opening lever 20 when the latter acts on swinging latch 19. A cocking hook 21 is mounted to pivot, around a pin 151, on cocking lever 15 and is subject to the biasing force of a return spring 22. This holds this opening lever 20 in the "on" or "tripped" position. Upon opening, cocking hook 21 frees opening lever 20 which is subject to the biasing force of opening spring acting on return swingletree 10. Consequently, opening lever 20 pivots from the "on" position to the "tripped" position. By arriving at the "tripped" position, opening lever 20 acts on latch 19 to free cocking part 16. The latter activates cocking lever 15 which pivots from the "on" position to the "tripped" position and grasps opening lever 20, by the cocking hook 21.

The thermal trip mechanism and the magnetic trip mechanism of unit 8 act on a trip mechanism able to free opening lever 20 of cocking lever 15 so as to trip the passage from the "on" position (FIG. 3) to the "tripped" position (FIG. 5). This trip mechanism acts on cocking hook 21 by a swinging pusher 25. The swinging pusher 25 is mounted to pivot around pin 161 and is subject to the biasing force of a spring 26. This spring 26 is mounted between a pin 252 of pusher 25 and a pin 242 of trip latch 24. Spring 26 tends to cause swinging pusher 25 to rotate in the direction of opening of cocking hook 21. The trip mechanism comprises pivoting of trip latch 24 that can pivot around a pin 241, either under the action of thermal trip mechanism 81 or of magnetic trip mechanism 82. By pivoting, trip latch 24 frees swinging pusher 25 subject to the biasing action of a spring 26. Swinging pusher 25 opens cocking hook 21 which frees opening lever 20.

Swinging pusher 25 cooperates with a recocking lever 32 mounted so as to pivot around stationary pin 241 and is connected by a pin 321 to cocking part 16. This recocking lever 32 acts on a pin 251 of swinging pusher 25 so as to recock it.

Mechanism pin 14 which carries rotary manual control knob 12 is integral with a rocker 29. The unit consisting of rocker 29, pin 14 and control knob 12 is connected by a draw spring 27 to a crank 28 that can pivot freely, around mechanism pin 14, between two positions. Spring 27 is mounted between a pin 291 integral with rocker 29 and a pin 281 integral with crank 28.

Plates **13*a*–13*b*** are identical and assembled symmetrically, the pivoting parts of the lock being mounted to one another. Most of the springs can be put in place after the parts and the plates are assembled which facilitates assembly.

Thermal trip element 81 is mounted on a part 33 whose position in relation to plate **13*a*–13*b*** can be adjusted at the factory or by the customer.

Operation of the control mechanism will now be explained. In the "on" position corresponding to the closing of the contacts (FIG. 3), opening lever 20 occupies the beginning-of-travel position known as the "on position." It is held in this position by hook 21 and cocking lever 15. Cocking lever 15 is immobilized because of the fact that cocking part 16 is immobilized by latch 19. Rocker 29 is held in the "on" position by spring 27.

In the "off" position (FIG. 4), rocker 29 is in the "off" position, by spring 27 going beyond a neutral position.

Figure 4:
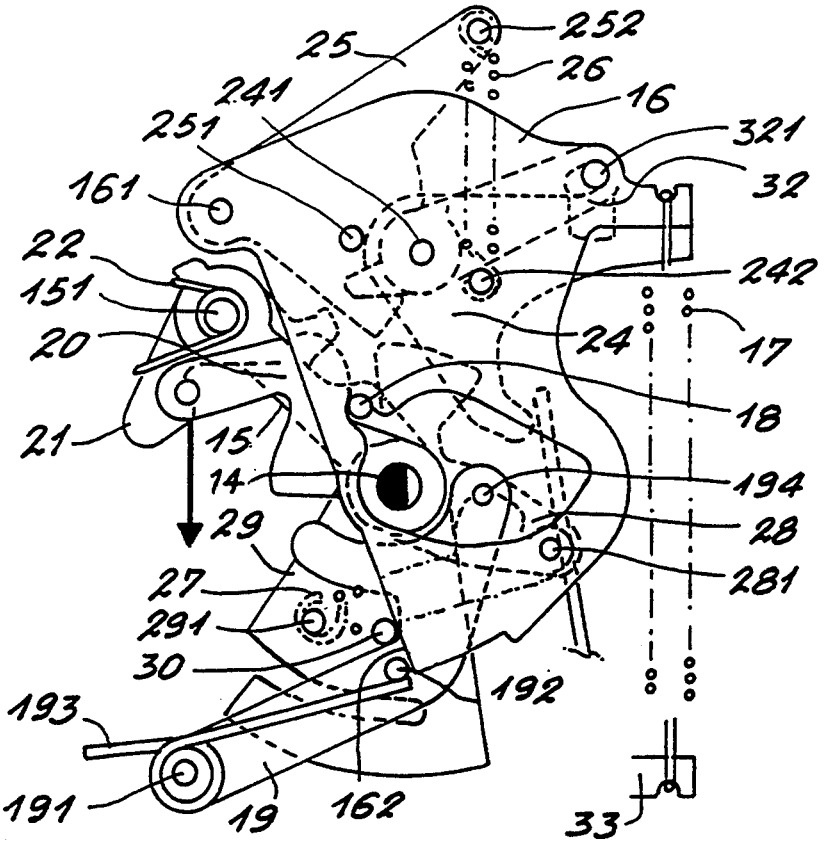
FIG. 4 is a simplified diagram of the control mechanism represented in an "off" position.

It is possible to go from the "on" position to the "off" position by turning rotary control knob 12. Mechanism pin 14, upon rotating, causes rocker 29 to rotate around pin 14, from the "on" position (FIG. 3) to the "off" position (FIG. 4). During the rotation, rocker 29 goes past a neutral position, in the plane passing through pin 14 and the pin for fastening spring 27 on crank 28. The latter swings while causing opening of the contact feeding the coil of the electromagnet and rocker 29 comes to occupy the end-of-travel "off". Spring 27 assures the holding of rocker 29 in this position by pin 30 which is stopped against cocking part 16.

Conversely, it is possible to go from the "off" position (FIG. 4) to the "on" position (FIG. 3), by turning rotary control knob 12. By passing the neutral position, rocker 29 causes crank 28 to pivot and thus activates the contact feeding the coil of the electromagnet.

Going from the "on" position (FIG. 3) to the "tripped" position (FIG. 5), is performed automatically in case of overload or failure. This causes an opening of the power contacts and an opening of the coil contact. One of trip mechanisms 81 or 82 acts on trip latch 24 which frees pusher 25. The latter acts on cocking hook 21 which by pivoting frees opening lever 20. By pivoting, opening lever 20 activates latch 19 which frees cocking part 16. This cocking part 16 subject to cocking spring 17 pivots and drives cocking lever 15 in rotation which pivots until assuming the "tripped" position. In this position, cocking hook 21 comes to connect opening lever 20 to cocking lever 15. Latch 19 causes crank 28 to pivot which activates the coil contact. Furthermore, cocking lever 15, via pin 151, causes rocker 29 to rotate until it passes the neutral position. Cocking part 16 then determines the position of rocker 29 and knob 12 ("tripped" position). In the "tripped" position, recocking lever 32 recocks pusher 25.

Recocking of the mechanism is performed from the "tripped" position to the "off" position or can also be performed from the "tripped" position to the "on" position (which can prove very advantageous in the case of a remote recocking by a small electric motor).

To recock, from the "tripped" position (FIG. 5) to the "off" position, rotary knob 12 is turned to the "off" position. A drive pin 30 integral with rocker 29 causes cocking part 16 to pivot which, by pin 18, rotates cocking lever 15, the latter driving opening lever 20 until it occupies the "on" position. At end-of-travel, latch 19, under the biasing action of spring 193, comes to lock, by a pin 192, cocking part 16 and the mechanically connected parts (opening lever 15, opening lever 20) in the "on" position.

To recock from the "tripped" position (FIG. 5) to the "on" position, rotary control knob 12 is turned from this "tripped" position to the "on" position. Rocker 29 integral with knob 12 causes cocking lever 15, opening lever 20 and cocking part 16 to pivot to the "on" position. At end-of-travel, latch 19 immobilizes cocking part 16, cocking lever 15 and opening lever 20 which remains hooked to cocking lever 15, by cocking hook 21.

In the case of an overload, if an operator prevents the rotation of control knob 12, opening lever 20 cannot be prevented from pivoting. The contacts can therefore open.

Rocker 29 activated by rotary knob 12 makes it possible to assure a forced opening of the coil contact and of the power contacts as well as the coil contact, by going to the "off" position. This position can be indicated only if all the contacts are actually open.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. A protective switch comprising:

at least one pole having at least one moving contact that cooperates with a stationary contact;

a control mechanism for actuating said moving contact;

a trip mechanism for assuring protection against overloads and excess currents and that acts on said control mechanism for actuating said moving contact;

a rotary knob rotatable around a pivot pin for activating said control mechanism, wherein the control mechanism comprises a lever for opening the contacts that is pivotable from an on position corresponding to closing of the contacts to a position corresponding to opening of the contacts; and a pivoting cocking mechanism for bringing back and holding said opening lever in the on position of the contacts, wherein said trip mechanism includes a mechanism for controlling the mechanical separation of the opening lever and of the cocking mechanism so as to free said opening lever.

2. Device according to claim 1, wherein the pivoting cocking mechanism comprises a cocking lever that is pivotable around said pivot pin, and said hooking mechanism is connected to said cocking lever for contacting said opening lever.

3. Device according to claim 1, which comprises a cocking spring wherein the cocking lever is connected mechanically in rotation to said pivoting cocking mechanism and is subject to biasing action by said cocking spring.

4. Device according to any one of the preceding claims, which comprises a hooking mechanism having a hook which is movable around said pivot pin.

5. Device according to claim 1, wherein the cocking mechanism comprises a latch for assuring immobilization of said cocking mechanism in an "on" position and freeing of said cocking mechanism under the action of the opening lever so that said cocking mechanism moves the opening lever from a "trip" position back into the "on" position.

6. Device according to claim 4, which comprises a pusher mechanism for freeing the opening lever by acting on a hook and trip device on which the trip mechanism acts for opening the lever.

7. Device according to any one of the preceding claims, which comprises a spring and a pivotable crank wherein the rotary knob is integral with a part connected by said spring to said pivotable crank.

8. Device according to any one of the preceding claims, which comprises two symmetrical plates for guiding said pivot pin.

9. Device according to claim 2, wherein said control knob has a part connected thereto which includes means for bringing the opening lever and the cocking lever from a "tripped" position to an "on" position.

* * * * *